US011543171B2

(12) United States Patent
Möller

(10) Patent No.: US 11,543,171 B2
(45) Date of Patent: Jan. 3, 2023

(54) DOOR SYSTEM FOR A REFRIGERATION DEVICE

(71) Applicant: REMIS Gesellschaft für Entwicklung und Vertrieb von technischen Elementen mbH, Cologne (DE)

(72) Inventor: Erik Möller, Cologne (DE)

(73) Assignee: REMIS Gesellschaft für Entwicklung und Vertrieb von techischen Elementen mhH, Cologne (DE)

( * ) Notice: Subject to any disclaimer, the term of this patent is extended or adjusted under 35 U.S.C. 154(b) by 708 days.

(21) Appl. No.: 16/490,463

(22) PCT Filed: Mar. 1, 2018

(86) PCT No.: PCT/EP2018/055054
§ 371 (c)(1),
(2) Date: Aug. 30, 2019

(87) PCT Pub. No.: WO2018/158371
PCT Pub. Date: Sep. 7, 2018

(65) Prior Publication Data

US 2020/0072532 A1 Mar. 5, 2020

(30) Foreign Application Priority Data

Mar. 2, 2017 (DE) ..... 102017203444.0

(51) Int. Cl.
*F25D 23/02* (2006.01)
*E05C 17/24* (2006.01)
(Continued)

(52) U.S. Cl.
CPC ..... *F25D 23/028* (2013.01); *E05C 17/24* (2013.01); *E05F 1/1091* (2013.01); *E05F 1/14* (2013.01);
(Continued)

(58) Field of Classification Search
CPC .. F25D 23/028; F25D 2323/024; E05C 17/24; E05F 1/1091; E05F 1/14;
(Continued)

(56) References Cited

U.S. PATENT DOCUMENTS 2,417,401 A * 3/1947 Steinhorst ..... F25D 23/028 292/268
2,903,149 A * 9/1959 Turner ..... E05F 1/1058 217/60 E
(Continued)

FOREIGN PATENT DOCUMENTS

DE 3346332 A1 7/1984
DE 20306043 U1 8/2004
(Continued)

OTHER PUBLICATIONS

Machine translation for DE202008013991 (Year: 2010).*
(Continued)

*Primary Examiner* — Hiwot E Tefera
(74) *Attorney, Agent, or Firm* — Lewis & Reese, PLLC

(57) ABSTRACT

The present invention relates to a door system for a refrigeration device and a refrigeration device with such a door system.

14 Claims, 14 Drawing Sheets

(51) Int. Cl.
*E05F 1/10* (2006.01)
*E05F 1/14* (2006.01)

(52) U.S. Cl.
CPC ..... *E05Y 2900/31* (2013.01); *F25D 2323/024* (2013.01)

(58) Field of Classification Search
CPC ..... E05F 3/221; E05F 1/1292; E05F 3/02; E05Y 2900/31; Y10T 16/551; Y10T 16/5445; Y10T 16/5448; Y10T 16/5453; A47F 3/043; E05D 11/06; E05D 7/081; E05D 2015/586; E05D 3/18
USPC ..... 49/339, 345, 346, 356
See application file for complete search history.

(56) References Cited

U.S. PATENT DOCUMENTS

| | | | | |
|---|---|---|---|---|
| 4,341,083 | A * | 7/1982 | Ibrahim | E05F 15/611 62/282 |
| 4,658,473 | A * | 4/1987 | Schema | F25D 23/028 16/382 |
| 6,212,827 | B1 * | 4/2001 | Miller | E05F 1/1091 49/340 |
| 8,839,559 | B2 * | 9/2014 | Neff | E05F 3/18 49/344 |
| 2005/0206286 | A1 | 9/2005 | Finkelstein | |
| 2006/0082164 | A1 * | 4/2006 | Shin | E02F 9/16 292/262 |
| 2008/0189906 | A1 * | 8/2008 | Resnik | E05D 3/16 16/54 |
| 2009/0033189 | A1 * | 2/2009 | Glanz | F25D 23/028 49/31 |
| 2009/0064463 | A1 | 3/2009 | Gomoll et al. | |
| 2009/0072551 | A1 * | 3/2009 | Hirtsiefer | E05F 1/1292 292/196 |
| 2010/0109497 | A1 * | 5/2010 | Blersch | E05D 15/408 312/405 |
| 2011/0089801 | A1 * | 4/2011 | Bonomie | F25D 23/028 16/249 |
| 2017/0081892 | A1 * | 3/2017 | Fan | E05F 3/10 |
| 2020/0217115 | A1 * | 7/2020 | Nuss | F25D 23/028 |

FOREIGN PATENT DOCUMENTS

| | | | | |
|---|---|---|---|---|
| DE | 202008013991 | U1 | 4/2010 | |
| DE | 202014005234 | U1 * | 9/2014 | E05C 17/24 |
| JP | 2011102496 | A * | 5/2011 | E05F 1/14 |
| WO | 2006/016304 | A2 | 2/2006 | |

OTHER PUBLICATIONS

Notification Concerning Transmittal of International Preliminary Report on Patentability regarding corresponding PCT Application No. PCT/EP2018/055054, dated Sep. 12, 2019.

Communication Pursuant to Article 94(3) EPC received in corresponding EP Application No. 18708406.6, dated Apr. 15, 2021.

International Search Report and Written Opinion regarding corresponding PCT Application No. PCT/EP2018/055054, dated Sep. 7, 2018.

Search Results regarding corresponding DE Application No. 102017203444.0, dated Oct. 23, 2017.

* cited by examiner

DOOR SYSTEM FOR A REFRIGERATION DEVICE

FIELD OF THE INVENTION

The present invention relates to a door system for a refrigeration device as well as to a refrigeration device with such a door system.

INTRODUCTION

Usually, door systems for refrigeration devices comprise at least one refrigeration device door which may be pivotally mounted to a refrigeration device by means of a corresponding bearing assembly. The refrigeration device door of door systems for cabinet-like refrigeration devices may be pivoted around a substantially vertical pivot axis between a closed position in which the refrigeration device is substantially closed by the refrigeration device door, and an open position which permits access to the interior of the refrigeration device. Such door systems or refrigeration device doors are also referred to as vertical door systems or vertical refrigeration device doors, respectively.

While being in the open position, the refrigeration device door is to permit an utmost easy access to the interior of the refrigeration device. Preferably, goods may then be quickly and easily deposited in the interior and/or taken out of the interior. In its closed position, the interior of the refrigeration device is to be closed by the refrigeration device door such that respective thermal losses are being minimized. For instance, the refrigeration device door locks the interior of the refrigeration device such that essentially no cold air may escape at an access opening. A door system for refrigeration devices is thus confronted with two substantial objects: On the one hand, it is to permit easy access to the interior of the refrigeration device; on the other hand, it is to enhance the energy efficiency of the refrigeration device.

A simple, vertically pivotally mounted refrigeration device door may, however, be inadvertently left in its open position after goods have been taken out or deposited. In this case, the refrigeration device door may not fulfill its insulating function, and the refrigeration device's energy efficiency is reduced correspondingly since, e.g., cooled air escapes. Moreover, partially self-autonomously closing refrigeration device doors are provided, which are, e.g., mounted to an inclined plane, which causes an automatic return of the refrigeration device door from an open position into a closed position. Such door systems are, however, disadvantageous due to their large space requirement for mounting them in a suitable manner. In addition, an autonomous closing may impede the taking out and/or depositing of goods.

SUMMARY

It is thus an object of the present invention to provide a door system for a refrigeration device which allows for goods to be easily deposited in and/or taken out of the interior of the refrigeration device and, at the same time, guarantees a particularly high efficiency of the refrigeration device. Furthermore, it is an object of the present invention to provide a refrigeration device with which these advantages are also put into effect.

According to the invention, this object is solved by a door system with the features of claim 1. Moreover, this object is solved by a refrigeration device with the features of claim 10. Advantageous embodiments with purposeful further developments of the invention are described in the respective subclaims, wherein advantageous embodiments of the door system are to be regarded as advantageous embodiments of the refrigeration device, and vice versa.

A first aspect of the invention relates to a door system for a refrigeration device, wherein the door system comprises at least one refrigeration device door and a corresponding bearing assembly. The bearing assembly is suitable for pivotally mounting the refrigeration device door to a refrigeration device such that the refrigeration device door may be pivoted around a substantially vertical pivot axis between a closed position in which the refrigeration device is being closed by the refrigeration device door, and an open position which permits access to the interior of the refrigeration device, wherein the refrigeration device door defines an opening angle relative to the refrigeration device. The door system further comprises at least one spring element which is connected to the refrigeration device door and suitable for engaging with the refrigeration device such that, at an opening angle smaller than a first critical angle, the spring element pushes the refrigeration device door into the closed position, and, at an opening angle greater than a second critical angle, the spring element pushes the refrigeration device door into the open position.

In this way, it is achieved that the refrigeration device door autonomously closes again at an opening angle smaller than a first critical angle. When the door is being opened only partially, i.e., when the door is being opened at an opening angle smaller than the first critical angle, a customer of a supermarket may, e.g., easily take out individual goods from the refrigeration device while it is simultaneously guaranteed that the refrigeration device subsequently closes again and the interior, i.e., the cooled interior of the refrigeration device, is closed again for a particularly low energy consumption of the refrigeration device and for sustaining the refrigerated temperature of the interior. At the same time, it is possible to open the refrigeration device door particularly far, i.e., farther than the second critical angle, wherein the refrigeration device door is then autonomously pushed into the open position and thus also held in the open position by the spring element. In this way, it is possible to open the refrigeration device door far enough for it not to autonomously close again. Hence, a potentially longer-lasting loading and unloading of a plurality of goods, e.g., by supermarket staff, is not being impeded by an otherwise autonomously closing door. Thus, goods may particularly easily be deposited or taken out. Thereby, the refrigeration device door may both be pushed open and closed by means of one single spring element, thus making the door system particularly cost-effective and space-saving.

Preferably, the first and second critical angles are identical so that the refrigeration device door is pushed into the closed position by the spring element when an opening angle is smaller than the first critical angle, and pushed into the open position by the spring element when an opening angle is greater than the first critical angle. The first critical angle may, however, be smaller than the second critical angle too. In particular at a difference between the first critical angle and the second critical angle, there may be a certain angular range of the opening angle in which no autonomous opening and/or closing of the refrigeration device door takes place. Said angular range may also be technically conditioned by friction in the bearing assembly and/or a lever arm of the spring element. Preferably, the difference between the second and first critical angle is less than 20°, more preferably less than 10°, and particularly preferably less than 5°.

The first critical angle is preferably greater than 60°, more preferably greater than 70°, and particularly preferably greater than 180°. The second critical angle is preferably smaller than 120°, more preferably smaller than 110°, and particularly preferably smaller than 100°. In a particularly preferred embodiment, both the first and second critical angles are within an interval of [80°, 100°], preferably within an interval of [85°, 95°].

In the open position, the opening angle is preferably at least 90°, more preferably at least 100°, and particularly preferably at least 110°. With doors directly adjoining each other, the open position may, however, also be defined by an opening angle that is smaller than 90°; for instance, 85°.

Preferably, the refrigeration device door comprises a main extension plane which is substantially parallel to the pivot axis. Thus, the main extension plane may be formed by the pivot axis and a direction perpendicular to the pivot axis. In this context, the pivot axis may also slightly deviate from a vertical, e.g., by 0.5°-3°, and the refrigeration device door may additionally comprise a certain curvature. A planar refrigeration device door and a perpendicular pivot axis are, however, particularly preferred.

The refrigeration device door may, e.g., be a refrigerator, a cooling cell, and/or a refrigerated shelf, particularly a professional refrigeration device for suppliers of refrigerated goods, e.g., for a supermarket. The refrigeration device door is preferably at least in sections transparent, particularly translucent, and may hereinafter simply be referred to as "door". In this context, the refrigeration device door may, e.g., be configured as a glass or plastic door. In this way, goods stored behind the refrigeration device door within the refrigeration device are also discernible from the outside when the door is in the closed position. The refrigeration device door may have an insulating function; particularly, respective sealing elements, e.g., in the form of sealing lips, may be provided at a contact surface of the refrigeration device door with the refrigeration device. The refrigeration device door may comprise, e.g., multiple glazing, wherein an insulation gas may be provided in an interspace between the respective glass layers. The door system may, e.g., also be configured as a double door system in which two doors of the refrigeration device are provided next to one another in the horizontal direction, wherein the respective pivot axis is preferably arranged on a side facing away from the adjacent swing door. In principle, the door system may comprise a plurality of refrigeration device doors. In order to be opened and/or closed, the respective refrigeration device door may exclusively be rotated around its pivot axis; however, in order to be opened and/or closed, embodiments may also be provided in which the refrigeration device door both rotates around its pivot axis and carries out a translational movement in order to unblock a particularly large access opening.

An access opening of the refrigeration device may at least in sections be limited by a frame element which is connected or connectable with the remaining housing of the refrigeration device. With the help of said frame, the door system may particularly easily be attached to the housing of the refrigeration device, for instance by way of fixing the bearing assembly to the frame. However, the door system may, e.g., also be fixed directly to the housing of the refrigeration device by means of the bearing assembly. The bearing assembly may be covered by the frame of the refrigeration device and/or by other elements, particularly additional covers. In this way, the bearing assembly may be protected against contamination. Moreover, the bearing mechanism of the door system may be concealed to users of the refrigeration device by means of respective cover elements, thus giving a particularly high-quality impression of the refrigeration device.

The closed position of the refrigeration device door may be defined by way of the refrigeration device door abutting the refrigeration device, particularly a housing of the refrigeration device, and thus, concomitantly, by closing the interior of the refrigeration device. The open position may be defined as being a position in which the spring element autonomously pushes the refrigeration device door without any further forces being exerted when the door has been at an opening angle beforehand which is greater than the second critical angle. If necessary, it may be possible for the refrigeration device door to be opened manually even further. The opening angle of the refrigeration device door may particularly be defined by an angle between a main extension plane of the refrigeration device door and a side of the refrigeration device facing the refrigeration device door. The side facing the refrigeration device door may particularly also correspond to a plane which is defined by an access opening to the interior of the refrigeration device. Thus, the opening angle may be formed by an angle between the main extension plane of the door and a main extension plane of the access opening.

In the open position, the opening angle is preferably at least 90°, more preferably at least 100°, and particularly preferably at least 110°. With doors directly adjoining each other, the open position may, however, also be defined by an opening angle smaller than 90°, e.g., 85°. When the opening angle in the open position is, e.g., 120°, the door system may be configured such that, e.g., the spring element pushes the refrigeration device door into the open position when the opening angle is from 90° to 120°. When the opening angle is smaller than, e.g., 90° to 0°, the spring element pushes the refrigeration device door into the closed position (with an opening angle of 0°). When the door is mounted to the remaining refrigeration device, an opening angle of 0° corresponds to the closed position of the refrigeration device door, i.e., the refrigeration device door abuts the refrigeration device and seals it off. In this context, the spring element is preferably configured and/or mounted such that it still exerts a closing force on the refrigeration device door when the door is in the closed position in order to make sure that the refrigeration device door remains closed.

Here, the force which the spring element exerts on the refrigeration device door is configured such that it takes into account the weight of the refrigeration device door and the frictional forces occurring during pivoting. Preferably, the spring element is suitable for exerting a force within the range of 20 N and 80 N, preferably 30 N and 60 N.

In a further preferred embodiment of the door system according to the invention, the spring element comprises a gas pressure spring. In particular, the spring element may be configured as a gas pressure spring. The gas pressure spring may also be referred to as a gas spring. A gas pressure spring may provide a high force for pushing the door into the closed position and/or the open position in a particularly space-saving manner. Moreover, a gas pressure spring is wear-resistant and forms a closed spring system. Users of the refrigeration device may thus hardly interfere with the mechanics of the bearing assembly. In particular, users may hardly catch their fingers, as would easily be the case with a helical spring.

In a further preferred embodiment of the door system according to the invention, the door system further comprises an eccentric element by means of which the spring element is connected with the refrigeration device door. In particular, the spring element may be fixed to the refrigeration device door in a manner spaced apart from the refrigeration device door and, in particular, its pivot axis by means of the eccentric element. Preferably, the spacing is in a plane perpendicular to the main extension plane of the refrigeration device door and/or the pivot axis, which may also be referred to as a horizontal plane. A door-side end of the spring element may thus be connected with the refrigeration device door by means of an eccentric element. In this way, a lever arm may be provided, with the help of which the step of pushing the refrigeration device door into the closed position and/or open position may be achieved by the spring element with a particularly low force. In this way, the spring element may be particularly small and cost-effective. Furthermore, the first critical angle and the second critical angle may be determined particularly easily by an angle in the horizontal plane between the eccentric element and the main extension plane of the refrigeration device door.

In a further preferred embodiment of the door system according to the invention, it is provided that the alignment of the eccentric element is adjustable with respect to the refrigeration device door in order to determine the first critical angle and/or the second critical angle. In this way, it may be adjusted particularly quickly and easily at which angles of aperture the refrigeration device door autonomously closes and/or opens. Thus, the door system may be customized to particular boundary conditions of the intended place of installation of the refrigeration device, for example to take into account particular obstacles in an opening area of the refrigeration device door.

Preferably, the adjustment is caused by altering an angle between the eccentric element and the refrigeration device door in the horizontal plane. In this context, the angle may particularly be defined between the main extension plane of the refrigeration device door and by an imaginary line between a fixing point of the spring element with the eccentric element and the pivot axis. As an alternative, adjustability may also be achieved by replacing the eccentric element, which then has a different length and/or shape. By means of the angle and/or the distance of the door-side end of the spring element to the pivot axis of the refrigeration device door, also the force by means of which the spring element pushes the refrigeration device door into the open position and/or closed position may easily be altered.

In a further preferred embodiment of the door system according to the invention, it is provided that said door system comprises at least one restriction member by means of which the opening angle of the refrigeration device door is restricted to a maximum opening angle. The restriction member may, e.g., be configured as a stopper. With the help of the restriction element, the maximum opening angle and/or also the opening angle in the open position may easily be customized to particular general conditions of the intended place of installation of the refrigeration device. For instance, also in this way a smaller opening angle may be provided as an open position when the refrigeration device is to be installed in a corner of a room. Additionally, it may be provided for adjacent refrigeration devices whose respective doors move towards each other when being opened that said doors cannot clash when in the open position, i.e., at their maximum angles of aperture. In this case, e.g., a maximum opening angle of smaller than 90° may be provided. Otherwise, a maximum opening angle of up to 120° may preferably be provided for a particularly easy access to the interior of the refrigeration device. In this context, the restriction member may additionally support the refrigeration device door and thus protect the bearing assembly from overload. Additionally, the restriction member may protect the spring element from overload, particularly from overstretching and concomitant damage during opening and/or attempted opening beyond the open position and/or the maximum opening angle. The spring element that is configured as a gas pressure spring may also serve as restriction member. This configuration of the door system is particularly cost-effective.

In a further preferred embodiment of the door system according to the invention, it is provided that the maximum opening angle is adjustable. For this purpose, it may particularly be provided that the restriction member comprises an adjustment member, particularly a screw member, by means of which the maximum angle is adjustable. For instance, the restriction member may be a screw rod whose length is alterable by screwing together or unscrewing two respective screw members. As an alternative, for example, also a restriction member configured as a stopper may be fixed to the refrigeration device door and/or the refrigeration device in an adjustable position. In this way, the door system may particularly quickly and easily be customized to particular general conditions of the intended place of installation.

In a further preferred embodiment of the door system according to the invention, it is provided that the restriction member is configured as a coupling rod with a first end and an opposite second end, wherein the first end of the coupling rod is connected with the refrigeration device door and the second end of the coupling rod is suitable for engaging with the refrigeration device. As a result, the refrigeration device door may be mounted to the refrigeration device in the manner of a three-point bearing. The refrigeration device door is thus supported not only at the pivot axis but additionally by the restriction member. The restriction member has thus not only the function of a stopper but also that of additionally supporting the door. Thus, the refrigeration device door may take up particularly high loads of misuse, e.g., when people prop themselves on a handle of the refrigeration device door. The door system, in particular its bearing assembly, may thus be particularly compact and robust. The coupling rod may in this context be configured as a straight, continuous, and uniform element, which makes it particularly robust and cost-effective. In the simplest case, the coupling rod is in fact simply a continuous rod with two fixation means at its respective ends. The coupling rod may, however, also consist of a plurality of elements, e.g., two elbows pivotally mounted to each other. Such a design is particularly compact.

In a further preferred embodiment of the door system according to the invention, it is provided that the first end of the coupling rod is rotatably connected with the refrigeration device door, and that the second end of the coupling rod is suitable for being received in a guiding rail in a sliding and pivotable manner. The guiding rail may particularly be a guiding rail of the refrigeration device, which may, e.g., also be incorporated in a frame of the refrigeration device. As an alternative, the first end of the coupling rod may be slidably and pivotally received in a guiding rail of the refrigeration device door, and the second end of the coupling rod may be suitable for being pivot-mounted on the refrigeration device. Both alternatives constitute particularly compact but still simple designs of the restriction member. The first alternative with the rotatable connection of the coupling rod with the refrigeration device door allows for a particularly compact design since the guiding rail may be incorporated at the refrigeration device in a particularly space-saving manner in order for the second end to be slidably received. The second alternative, in which the first end of the coupling rod is slidably received in a guiding rail of the refrigeration device door and the second end is being pivotally fixed to the refrigeration device, allows for a particularly easy retrofitting of an already existing refrigeration device with the door system. In this case, the guiding rail may be a part of the bearing assembly and/or the refrigeration device door of the door system.

Preferably, at least at one side the restriction member is connected with the refrigeration device door and/or connectable with the refrigeration device with the help of a plug connection. For instance, on the side of the door, the restriction member is plugged on or, on the side of the refrigeration device, can simply be plugged on. Such a connection is rapidly releasable. In this manner, the refrigeration device door may be installed and maintained particularly quickly and easily. At the same time, the restriction of the maximum opening angle may thus quickly be made void, in particular without the use of tools, in order to make accessible points of the bearing assembly of the door system which would otherwise be hard to reach, for example for cleaning purposes.

For instance, the guiding rail may be configured as a header rail with a sliding groove, or as a simple groove. The guiding rail may particularly be aligned parallel to an upper and/or lower edge of the housing of the refrigeration device. In this context, a length of the guiding rail may also codetermine the maximum opening angle. In doing so, the length of the guiding rail may easily be changed by means of a movably fixable stopper in the guiding rail, said stopper then also being usable as a restriction member.

In a further preferred embodiment of the door system according to the invention, it is provided that the door system comprises a damping member by means of which a pivoting movement of the refrigeration device door from the open position into the closed position and/or a pivoting movement of the refrigeration device door from the closed position into the open position is being damped. The damping member may be incorporated in a spring member configured as a gas pressure spring in a particularly simple and cost-effective manner, said gas pressure spring being able to comprise as a damping mechanism, e.g., a hole in a movable piston. As an alternative or in addition, damping members may also be fixed at the guiding/mounting rail against the door or mounted within the guiding rail against the glider of the coupling rod. By means of damping, an abrupt striking of the refrigeration device door in the closed position against the refrigeration device and/or in the open position against a potential restriction member may be prevented. Before reaching the open position and/or the closed position, the pivoting movement of the refrigeration device door may be slowed down by the damping member. Accordingly, a particularly autonomous closing and/or opening of the refrigeration device door is being achieved. In this way, the bearing assembly of the door system is only particularly slightly being loaded, thus making it possible to reduce wear and respective maintenance intervals of the door system. At the same time, a particularly high-quality impression is created when using the door system.

The refrigeration device door preferably comprises a center plane defined by the two outer surfaces, wherein the two outer surfaces of the refrigeration device are the two main surfaces, i.e., the surface of the (mounted) refrigeration device door facing towards the outside and the opposite surface facing towards the inside. The center plane is the plane (or curved surface) whose distance to the two outer surfaces is the same at any point (measured perpendicular to the tangent at the plane or the curved surface at the respective point). In case one of the outer surfaces or both of them are not planar, the center plane may also be a nonplanar, e.g., curved, surface. Furthermore, the bearing assembly defines a pivot axis that is preferably offset with respect to the center plane, i.e., the center surface. Preferably, the distance between the pivot axis and the center plane, i.e., the center surface, is at least 3 mm, more preferably at least 5 mm, even more preferably at least 6 mm, even more preferably at least 7 mm, and particularly preferably at least 8 mm.

With this offset, the refrigeration device door according to the invention—when in the mounted state, i.e., when being pivotally mounted to a refrigeration device—allows for an outwardly displaced pivot and/or rotary axis. This, in turn, preferably allows for mounting the refrigeration device door as close to the front side of the refrigeration device as possible without restricting its movability. In other words, according to the invention, the gap existing between the refrigeration device door on the one hand and the front side of the refrigeration device on the other hand may be configured to be very narrow, which, inter alia, makes it possible to do without additional sealing measures. This is particularly advantageous when the refrigeration device door is substantially configured to be completely transparent, i.e., when there are transparent spacers between, e.g., the two transparent panes of the refrigeration device door, so that also the lateral edge sections of the refrigeration device door are transparent.

It is further preferred that the refrigeration device door comprises a lateral plane defined by the lateral front wall, and that the bearing assembly defines a pivot axis which is offset inwardly towards the refrigeration device door with respect to the lateral plane. Preferably, the distance between the pivot axis and the lateral plane is at least 3 mm, more preferably at least 5 mm, even more preferably at least 6 mm, even more preferably at least 7 mm, and particularly preferably at least 8 mm. Also this offset to the inside may contribute to keeping the gap between the refrigeration device and the refrigeration device door as narrow as possible and, at the same time, doing without additional measures such as, e.g., rounding off the lateral front wall.

A second aspect of the invention relates to a refrigeration device with a door system according to the first aspect of the invention. By means of the bearing assembly, the refrigeration device door is mounted pivotally to the refrigeration device such that the refrigeration device door may be pivoted around a substantially vertically aligned pivot axis between a closed position in which the refrigeration device is being closed by the refrigeration device door and an open position which allows for access to the interior of the refrigeration device, wherein the spring element is connected with the refrigeration device such that, at an opening angle smaller than a first critical angle, the spring element pushes the refrigeration device door into the closed position and, at an opening angle greater than a second critical angle, the spring element pushes the refrigeration device door into the open position.

Thus, a door system according to the first aspect of the invention is used with the refrigeration device according to the second aspect of the invention. The features and advantages resulting from the use of the door system according to the first aspect of the invention can be taken from the descriptions of the first aspect of the invention, wherein advantageous embodiments of the first aspect of the invention are to be considered as advantageous embodiments of the second aspect of the invention, and vice versa.

Consequently, it may advantageously be achieved that the refrigeration device door remains in the open position in order for the cooling chamber of the refrigeration device to be particularly easily loaded and unloaded in the open position, and that this procedure may be carried out particularly easily without interference of the refrigeration device door. Otherwise, when the refrigeration device door is only partially open, as is usual, e.g., for taking out individual goods, it autonomously returns into the closed position in order to guarantee a particularly high energy efficiency of the refrigeration device.

In this context, the refrigeration device may comprise a frame that at least partially restricts the access opening and to which the door system is being fixed and/or the refrigeration device door is mounted. Preferably, the refrigeration device additionally comprises respective covers and/or cover elements in order for the bearing assembly of the door system to be protected against contamination and/or concealed to users of the refrigeration device.

In a further preferred embodiment of the refrigeration device according to the invention, it is provided that the refrigeration device comprises a coupling rod with a first end and an opposite second end, wherein the first end of the coupling rod is pivotally connected with the refrigeration device door, and the second end of the coupling rod is displaceably and pivotally connected with the refrigeration device. Alternatively, the first end of the coupling rod is displaceably and pivotally connected with the refrigeration device door, and the second end of the coupling rod is pivotally connected with the refrigeration device. In order to displaceably mount the respective end of the coupling rod, it may be mounted in a guiding rail of the refrigeration device door or a guiding rail of the housing of the refrigeration device of the frame of the refrigeration device. Thus, a particularly simple but flexibly adaptable restriction for a maximum opening angle of the refrigeration device door is achieved. In addition, the support of the refrigeration device door is strengthened.

In a further preferred embodiment of the refrigeration device according to the invention, it is provided that the refrigeration device or the refrigeration device door comprises a guiding rail at an upper and/or lower edge, wherein the second end of the coupling rod is slidably and pivotally mounted in the guiding rail. Such a mounting is space-saving, robust, and in addition particularly easy to conceal on the side of the housing.

In a further preferred embodiment of the refrigeration device according to the invention, it is provided that the guiding rail comprises a stopper by means of which the opening angle of the refrigeration device door is restricted to a maximum opening angle. In this way, the maximum opening angle may be restricted in a particularly cost-effective and easy manner, while at the same time the coupling rod may very well reinforce the bearing assembly of the refrigeration device door with respect to loads of misuse.

In a further preferred embodiment of the refrigeration device according to the invention, it is provided that the refrigeration device comprises an eccentric element by means of which the spring element is connected with the refrigeration device door, wherein a first end of the spring element is pivotally connected with the eccentric element, and an opposite second end of the spring element is pivotally connected with the refrigeration device. This allows for a particularly good force transmission of the spring element in order for the refrigeration device door to autonomously pivot into the open position and/or the closed position.

As already mentioned above, the present invention makes it possible, inter alia, to keep the gap between the refrigeration device and the refrigeration device door as narrow as possible, which, inter alia, has the advantage that additional sealing measures between the refrigeration device and the refrigeration device door as well as between two adjoining refrigeration device doors may be dispensed with. Preferably, the distance between the refrigeration device and the refrigeration device door is at most 6 mm, more preferably at most 5 mm, and particularly preferably at most 4 mm. In this context, the distance is the dimension between the inward-looking surface of the refrigeration device door and the front surface (i.e., facing the door) of the refrigeration device (without door).

BRIEF DESCRIPTION OF THE DRAWINGS

Further advantages, features, and particulars of the invention can be taken from the subsequent description of a preferred embodiment as well as from the figures. The aforementioned features and feature combinations that are given in the description and the following features and feature combinations that are subsequently given in the description of the drawings and/or individually shown in the drawings cannot only be used in the respectively given combination but also in other combinations or alone without leaving the scope of the invention.

In this context.

DETAILED DESCRIPTION

Figure 1:
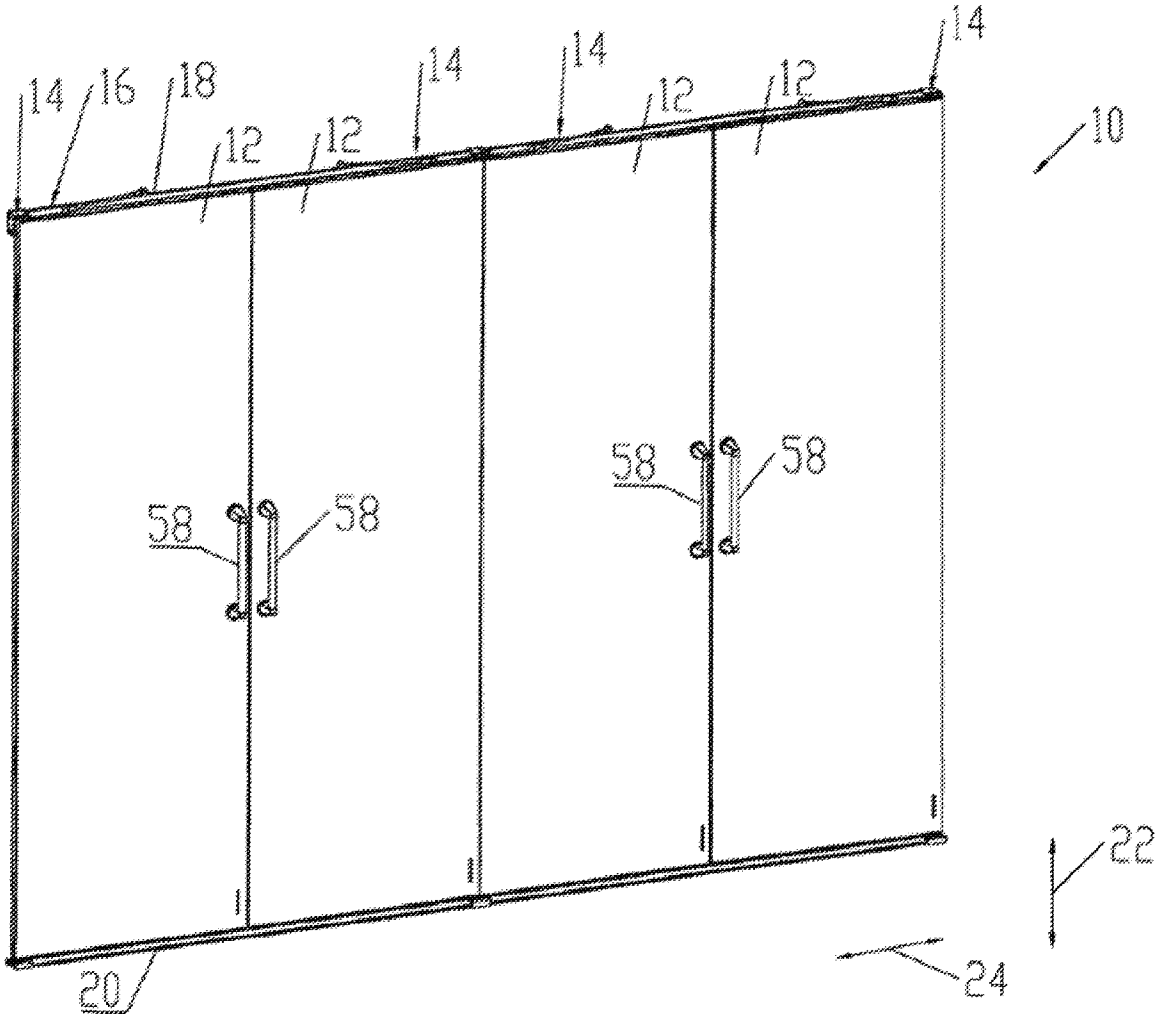
FIG. 1 shows a perspective view of a door system for a refrigeration device according to a preferred embodiment of the present invention.

FIG. 1 shows a perspective view of a door system 10 for a non-illustrated refrigeration device. In the embodiment shown, the door system 10 comprises four refrigeration device doors 12, wherein every refrigeration device door 12 comprises a corresponding bearing assembly 14. By means of the bearing assembly 14, the refrigeration device doors 12 may be pivotally mounted to a refrigeration device such that the refrigeration device doors 12 may be pivoted around a substantially vertically aligned pivot axis between a closed position, in which the refrigeration device is being closed by the refrigeration device door 12, and an open position, which allows access to the interior of the refrigeration device.

Figure 6:
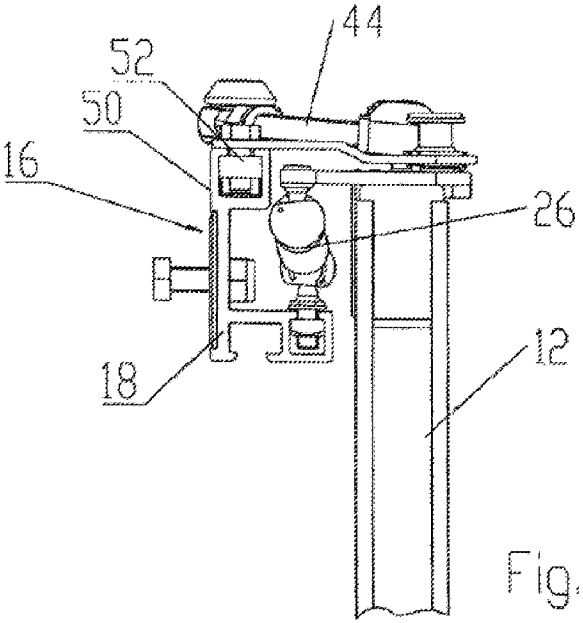
FIG. 6 shows a lateral view of the portion of the door system according to FIG. 4 marked with Y.

In their main extension directions, the refrigeration device doors 12 extend substantially vertically; e.g., the refrigeration device doors 12 are employed with refrigerated shelves. The refrigeration device doors 12 each comprise a handle 58 and are, e.g., configured with double glazing between which an insulation gas is arranged in a free space. This can particularly be taken from FIG. 6. In this way, the refrigeration device doors 12 may efficiently thermally seal off respective corresponding refrigeration devices and at the same time additionally make it possible for the respective goods stored within the refrigeration devices to be discerned from outside when the doors are closed.

In this context, the central refrigeration device doors 12 are mounted such that they pivot towards each other. The two outer refrigeration device doors 12, however, swing open outwardly. The bearing assembly 14 of the two central refrigeration device doors 12 shares a common bearing member, which saves space and weight. Here, the bearing assembly 14 comprises an upper bearing and a lower bearing for the refrigeration device doors 12. By means of the upper and lower bearings, a pivot axis of the respective refrigeration device door 12 is defined, which in this case substantially corresponds to an outer vertical edge of the refrigeration device door 12 and is stationary relative to the refrigeration device at the door system 10 mounted thereto.

In the example shown in FIG. 1, the door system 10 further comprises a frame 16 which is formed by an upper ledge 18 and a lower ledge 20. By means of said frame 16, the door system 10 may be retrofitted at an already existing refrigeration device without difficulty. As an alternative, the frame 16 may already be a part of the refrigeration device, too, and, e.g., be fixed to the device's housing or firmly integrated within its housing. Both the frame 16 and parts of the bearing assembly 14 are, e.g., configured as metallic elements, particularly as food safe stainless steel elements. The handles 58 may, e.g., be configured as plastic elements in order to create a warm surface feel, and, e.g., be screwed together with respective glass panes of the refrigeration device door 12. The design of the frame 16, in particular the upper ledge 18, may very well be seen in the sectional lateral view according to FIG. 6.

Figure 4:
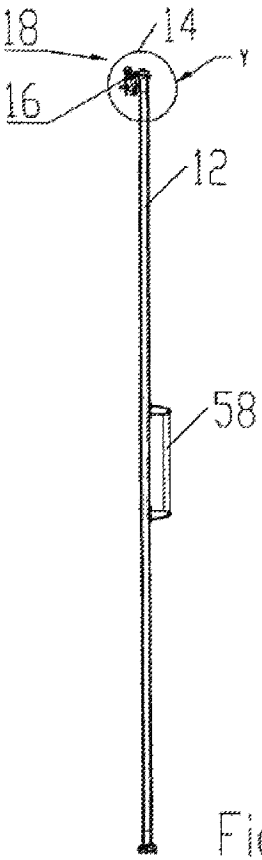
FIG. 4 shows a lateral view of the door system according to FIG. 1.
Figure 2:
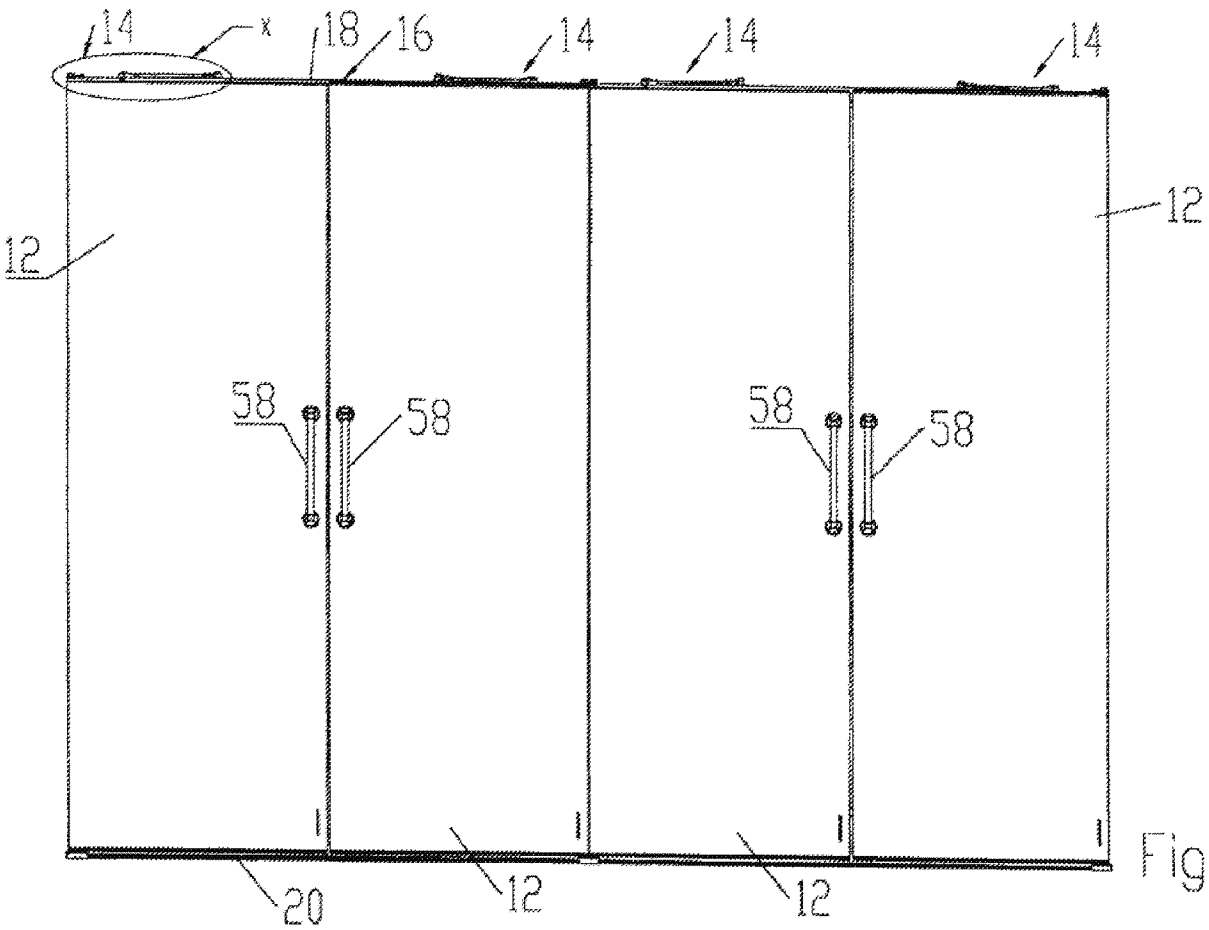
FIG. 2 shows a front view of the door system according to FIG. 1.
Figure 3:
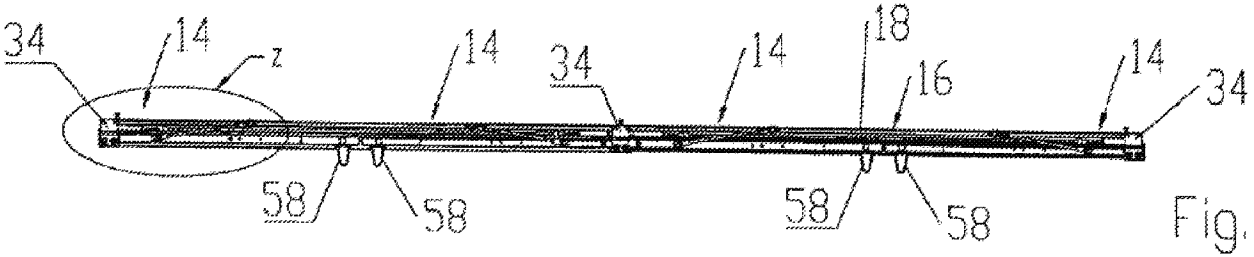
FIG. 3 shows a top view of the door system according to FIG. 1.

The design of the door system 10 may also very well be seen in the front view according to FIG. 2, the top view according to FIG. 3, and also in the lateral view according to FIG. 4. In these figures, it can also be seen that the door system 10 and, in particular, the refrigeration device doors 12 are substantially configured as flat, planar elements. However, it is also conceivable to design a corresponding door system 10 in which the refrigeration device doors 12 comprise, e.g., a certain curvature in the vertical direction and/or in the lateral extension. Also in this case, the door system 10 may be referred to as a substantially vertical door system.

In FIG. 1, the vertical direction is marked with arrow 22, a horizontal direction is marked with arrow 24. These markings of the vertical direction and the horizontal direction are also maintained in the remaining figures, where applicable.

Figure 5:
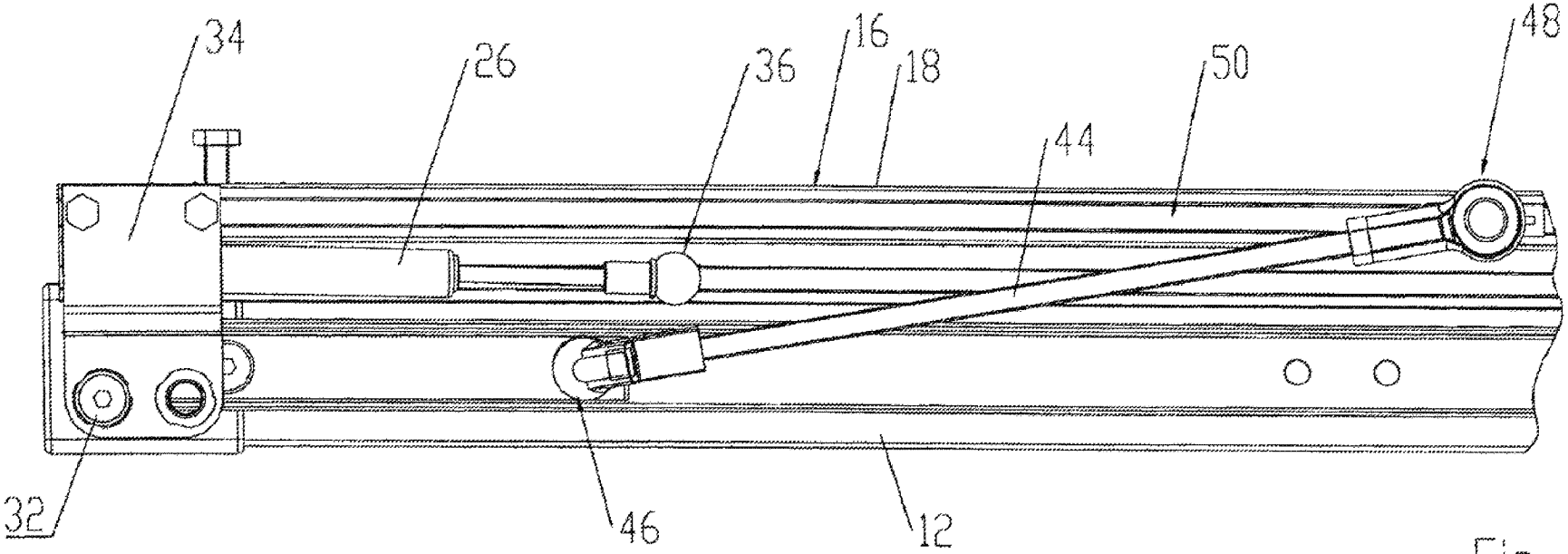
FIG. 5 shows a top view of the portion of the door system according to FIG. 3 marked with Z.

As can particularly be seen in the detailed top view according to FIG. 5, which corresponds to the portion marked with Z in FIG. 3, the door system 10 further comprises one spring element 26 per refrigeration device door 12, said spring element being connected with the refrigeration device door 12 and suitable for engaging with the refrigeration device such that the respective refrigeration device door 12, at an opening angle smaller than a first critical angle, is being pushed into the closed position by the spring element 26, and, at an opening angle greater than a second critical angle, is being pushed into the open position by the spring element 26. For this purpose, with its first end 30 the spring element 26 is connected with the refrigeration device door 12 on the side of the door by means of an eccentric element 28. This may particularly well be taken from the top views of the door system 10 according to FIGS. 12 and 13 since respective parts which do not cover the eccentric element 28 are not illustrated therein.

The eccentric element 28 is configured as an elongated, flat metal element which is fixed permanently with the refrigeration device door 12; in this case, e.g., by means of double screwing. Here, the first end 30 of the spring element 26 is pivotally mounted to the eccentric element 28. Due to the eccentric element 28, the spring element 26 is fixed spaced apart from the pivot axis of the refrigeration device door 12 in the horizontal direction. Here, in FIG. 5 the pivot axis of the refrigeration device door 12 approximately corresponds to, e.g., a screw connection 32 at which a retaining member 34 is connected with the frame 16. Furthermore, with its second end 36 on the side of the refrigeration device, the spring element 26 is attached at a fixed location to the frame 16 in a pivotable manner. By means of this fixation of the spring element 26, the spring element 26 exerts a closing or opening torque on the refrigeration device door 12 according to the opening angle of the refrigeration device door 12. In this way, the respective refrigeration device doors 12 may autonomously open, keep themselves open, and/or close.

Preferably one of the bearing assemblies 14 according to FIG. 5 is provided per refrigeration device door 12. Here, the spring element 26 is configured as a gas pressure spring, which makes the spring element 26 particularly wear-resistant and protects it from contamination. Moreover, at the same time a damping member may be incorporated within the spring element 26 in a space-saving and cost-effective way.

Figure 8:
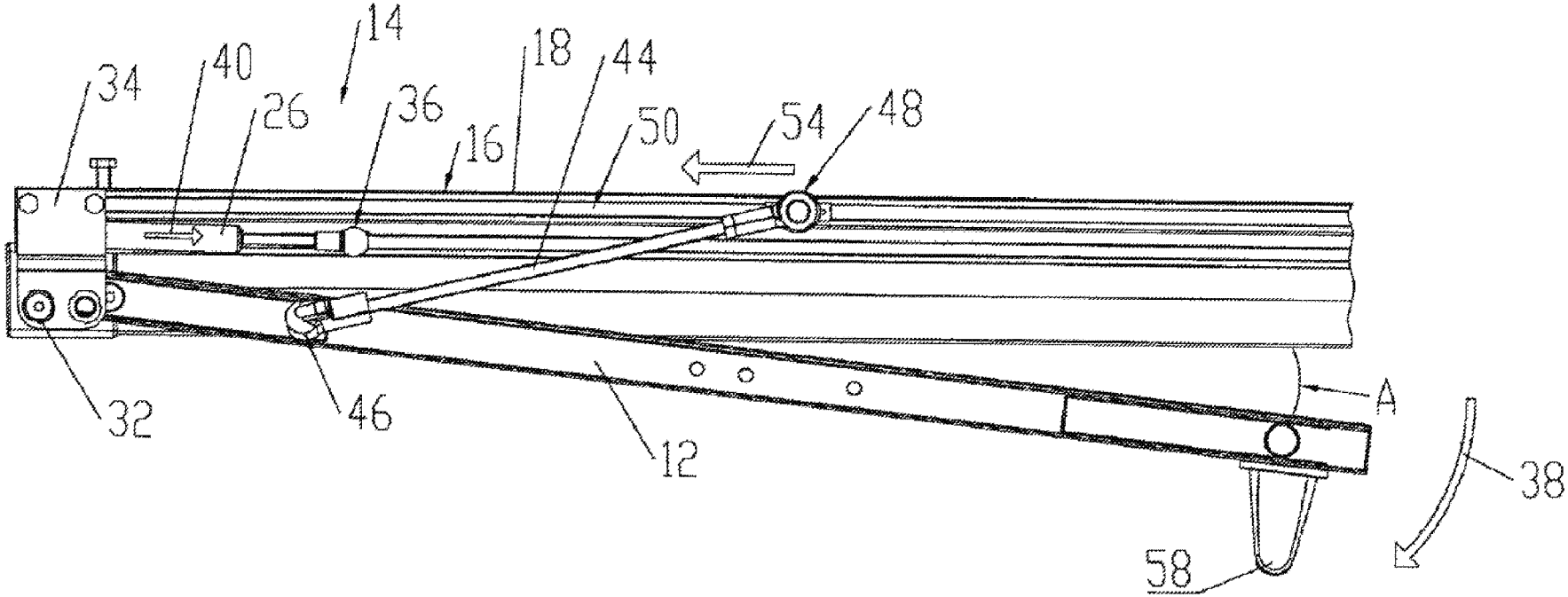
FIGS. 8 to 11 show segmental top views of different positions during a pivoting movement of the refrigeration device door of the door system according to FIG. 1 for opening and closing the refrigeration device.
Figure 9:
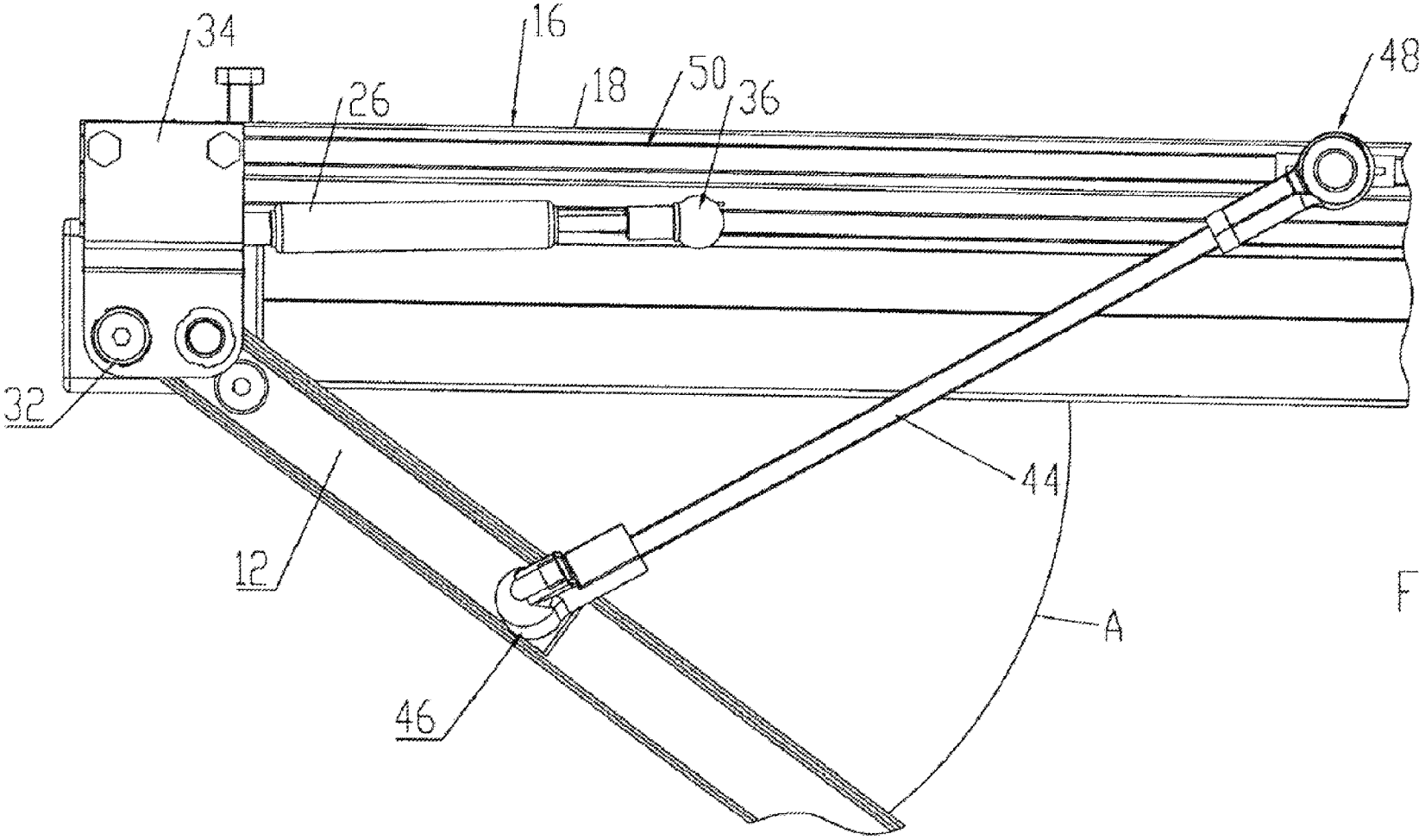
Figure 10:
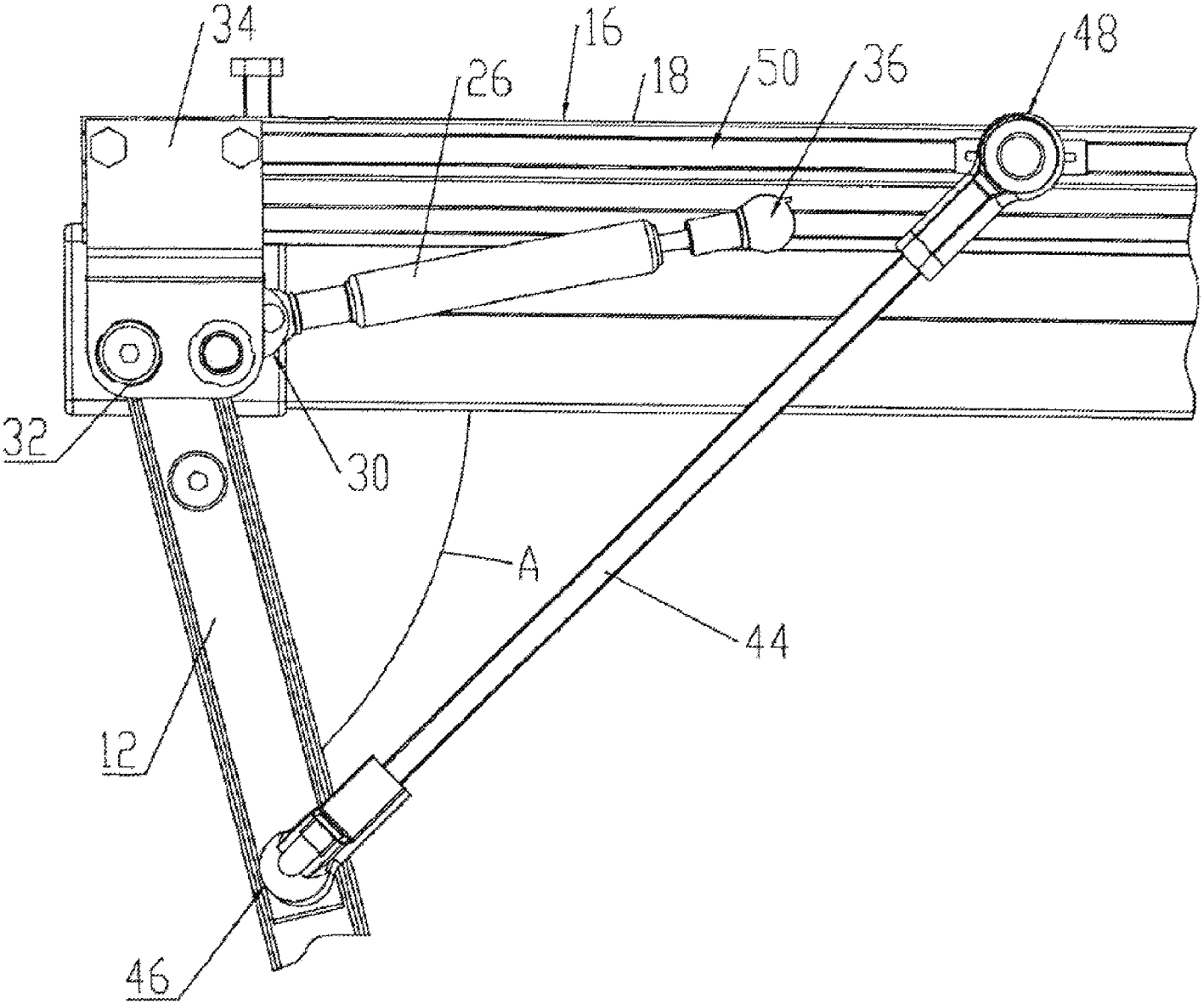
Figure 11:
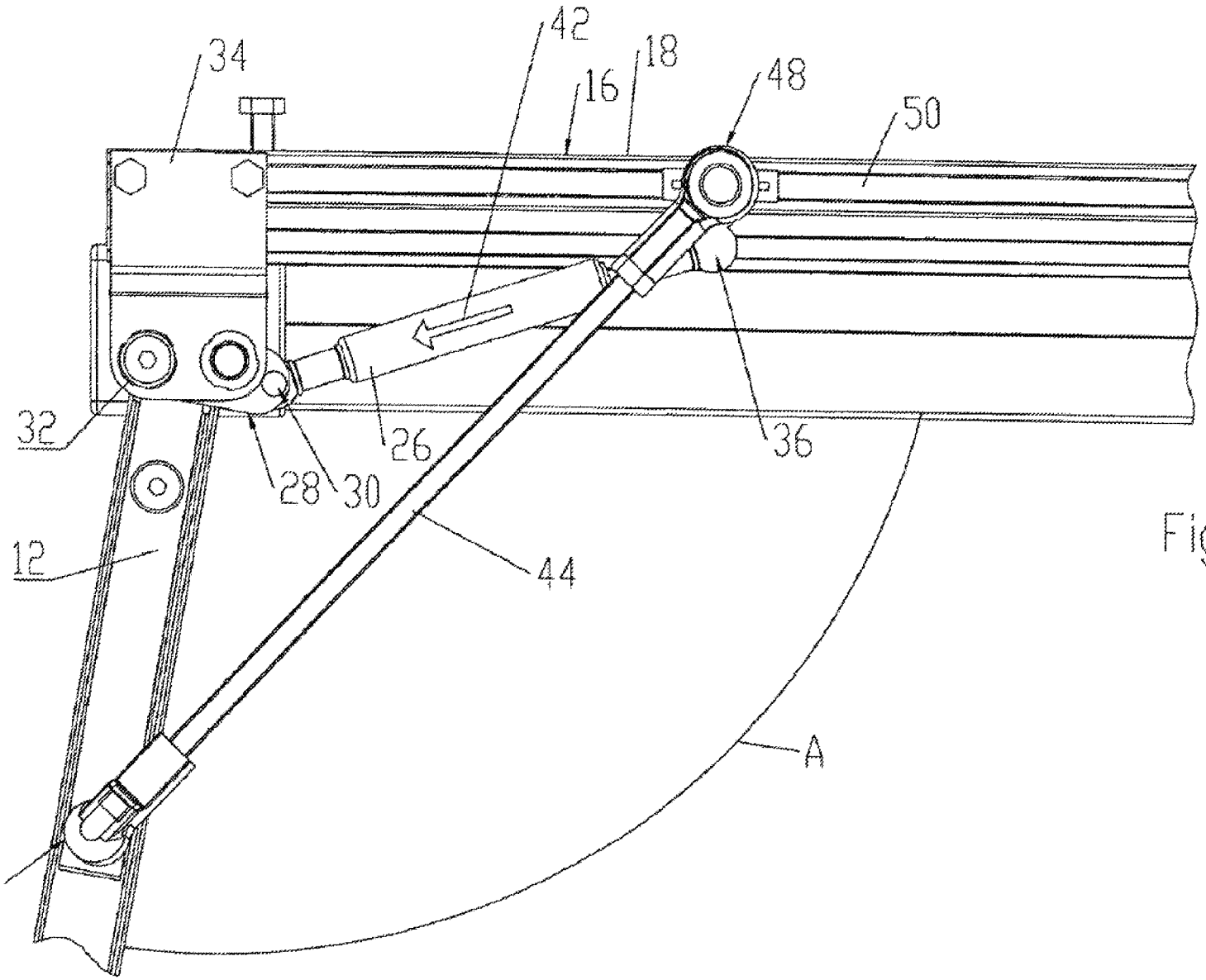

The respective segmental top views of the door system 10 according to FIGS. 8 to 11 again illustrate the operating principle of the spring element 26 during use of the refrigeration device door 12. As shown by arrow 38 in FIG. 8, pulling the handle 58 causes pivoting of the refrigeration device door 12 around its vertical pivot axis towards the outside in the horizontal direction. In this way, the interior of the refrigeration device can be accessed, e.g., in a supermarket in order for an end consumer to take out respective goods. During pivoting of the refrigeration device door 12, the spring element 26 is being compressed, which is demonstrated by arrow 40. A further compression of the spring element 26 when opening the refrigeration device door 12 farther is further shown in FIGS. 9 and 10. In case, e.g., in one of these positions of the refrigeration device door 12 the handle 58 is then being released, the spring element 26 will then exert a closing torque on the refrigeration device door 12 due to its being fixed spaced apart from the pivot axis of the refrigeration device door 12 by means of the eccentric element 28. By way of said torque, the refrigeration device door 12 is autonomously being turned back into the closed position in which the refrigeration device door 12 substantially abuts the frame 16 and/or a housing of the refrigeration device. As a consequence, the interior of the refrigeration device is being closed again and, e.g., cold air can no longer escape. In this way, a high cooling efficiency of the refrigeration device is being guaranteed. Additionally, users of the refrigeration device do not have to close the refrigeration device door 12 themselves, which renders the use for end consumers particularly convenient.

However, the spring element 26 exerts said closing torque only up until an opening angle of the refrigeration device door 12 that is smaller than a first critical angle. In this context, the opening angle corresponds to an angle between a main extension plane of the access opening of the refrigeration device, i.e., a plane formed by the frame 16, and a main extension plane of the refrigeration device door 12. In the figures, for instance, the opening angle is marked with A. At an opening angle of approx. 90°, however, the effective direction of the spring tension of the spring element 26 corresponds to a straight line between the first end 30 and the second end 36 of the spring element 26 as well as the pivot axis of the refrigeration device door 12, whereby the compressive force of the spring element 26 no longer has a lever arm and, consequently, no longer exerts a torque on the refrigeration device door 12. At such an opening angle of the refrigeration device door 12, the door will not autonomously close again.

At an opening angle A of more than 90°, however, the spring element 26 exerts a torque on the refrigeration device door 12, which causes the refrigeration device door 12 to open farther into the open position and/or also to be held in the open position. In this context, the open position corresponds to a maximum opening angle of the refrigeration device door 12, which in this case is, e.g., 120°. The autonomous opening of the refrigeration device door 12 is illustrated, e.g., in further top views in FIGS. 10 and 11. Accordingly, arrow 42 shows how in the open position of the refrigeration device door 12 the spring element 26 continues to exert a force that keeps open the refrigeration device door 12. The fact that the refrigeration device door 12 opens and also keeps itself open autonomously causes the refrigeration device door 12 to autonomously resort to and remain in its maximum open position. In this way, larger amounts of goods may then easily and rapidly be taken out of or deposited in the interior by means of the refrigeration device's access opening that is particularly broadly unblocked. For instance, supermarket staff can thus particularly easily stow larger amounts of goods on the respective refrigerated shelves. Then, for example, the access opening is released far enough for larger packages, such as pallets and cardboard boxes of goods, to be easily deposited. At the same time, no snap-shutting refrigeration device door 12 will threaten to impede this work, as is the case with, e.g., an inclined bearing for an autonomous closing of the door. If the wide access to the interior of the refrigeration device is no longer required, the refrigeration device door 12 may be closed by hand far enough for its opening angle to be smaller than the first critical angle. As of this point, the refrigeration device door 12 will again close autonomously.

The opening angle as of which the refrigeration device door 12 is autonomously being brought into the open position by the spring element 26 is also referred to as the second critical angle. Said second critical angle may, e.g., be 90°. In this case, the first critical angle and the second critical angle are thus identical so that there is only one angular point at which the refrigeration device door 12 is not autonomously being pushed into either the open position or the closed position by the spring element 26. Respective deviations from this angular point at which no autonomous opening or closing of the door occurs may in this context particularly be of technical nature, e.g., frictional.

Furthermore, the door system 10 comprises a restriction member 44. In the present case, the restriction member 44 is configured as a coupling rod and restricts the maximum opening angle of the refrigeration device door 12, thus making it possible, inter alia, to prevent the spring element 26 from overstretching. For this purpose, the coupling rod, i.e., the restriction member 44, is pivotally mounted to the refrigeration device door 12 with its first end 46 on the side of the door. At its second end 48, the restriction member 44 is slidably received in a guiding rail 50 in a pivotable and displaceable manner. In this context, the guiding rail 50 can particularly well be seen in FIG. 6. At its end 48, the coupling rod is mounted in a groove of the guiding rail 50 with a sliding head 52. Upon a pivoting movement for opening the refrigeration device door 12, the second end 48 of the restriction member 44 moves in the direction of the pivot axis, i.e., in the direction of an end on the side of the pivot axis of the guiding rail 50, as is illustrated by arrow 54 in FIG. 8. In the guiding rail 50, a stopper (not illustrated) is provided, and/or the groove of the guiding rail 50 may also end at a certain point so that the second end 48 of the restriction member 44 may not move further in the direction marked by arrow 54. Such a position can, e.g., be taken from FIG. 11. In this way, a further pivoting movement of the refrigeration device door 12 is prevented by the restriction member 44. Accordingly, the maximum opening angle has been reached. By an alteration of the length of the restriction member 44, an alteration of the position of the stopper and/or an alteration of the length and/or the position of the guiding rail 50 on the refrigeration device, a different maximum opening angle may thus be set in order to, e.g., prevent the refrigeration device door 12 in its maximum open position from clashing with opposite refrigeration device doors 12 pivoting in the opposite direction and/or with other obstacles such as, e.g., walls, columns, or shelves.

Figure 7:
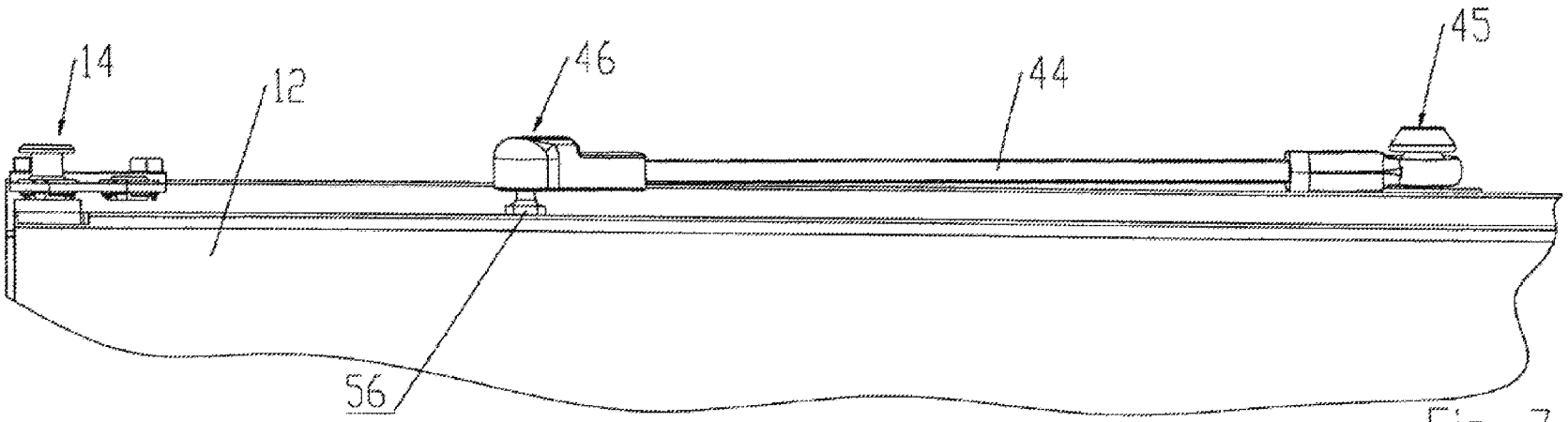
FIG. 7 shows a front view of the portion of the door system according to FIG. 2 marked with X.

As may be taken from the sectional front view according to FIG. 7, with its first end 46 the restriction member 44 is only plugged on a pin member 56 of the refrigeration device door 12. In this way, the restriction member 44 may quickly and easily be released by lifting from the pin member 56. Thus, the refrigeration device door 12 may then be opened manually beyond the maximum opening angle for maintenance and assembly purposes.

The bearing assembly 14 of the respective refrigeration device doors 12 is reinforced by means of the restriction member 44. Being mounted in a manner spaced-apart from the pivot axis, the restriction member 44 may particularly well withstand respective loads of misuse. For instance, the restriction member 44 may also take up respective bearing loads when shorter people prop themselves on the handle 58 in order to reach goods stored on higher shelves.

Due to the design with the eccentric element 28, the spring element 26 exerts a particularly high torque on the refrigeration device door 12 when it is opened particularly far or closed particularly far. In order to prevent an excessively hard stopping of the refrigeration device door 12 in its open position and its closed position, the door system 10 may comprise at least one damping member per refrigeration device door 12. For instance, the spring element 26 that is configured as a gas pressure spring may comprise an integrated damping by means of which an inadvertently strong acceleration of the refrigeration device door 12 during its autonomously closing and opening may be prevented. In this way, the longevity of the door system 10 is increased and the user gets a higher-quality impression. As an alternative or in addition, e.g., a damping member may also be provided in the guiding rail 50 and/or at the sliding head 52 or other positions of the restriction member 44.

The first critical angle, below which the refrigeration device door 12 closes autonomously, and the second critical angle, above which the refrigeration device door 12 opens autonomously, may be affected by the form of the eccentric element 28 and its relative alignment towards the refrigeration device door 12. As an alternative or in addition, the two critical angles may also be determined by the form of the spring element 26 and/or the position of the mounting of the second end 36 of the spring element 26 to the frame 16.

The present example shows that the door system 10 allows for a space-saving, autonomous closing of the refrigeration device door 12. The space of the upper guiding unit including the upper ledge 18 is, e.g., only 28-34 mm without the refrigeration device door 12. In this context, the depth corresponds to an extension into the sheet plane according to FIG. 2. A space height of this unit is, e.g., only 67-73 mm, wherein the height corresponds to an extension in the vertical direction. A length of the restriction member 44 is, e.g., only 220-240 mm between its two pivotal points. At a total weight of the refrigeration device door 12 of approx. 12-40 kg and a spacing of the first end 30 of the spring element 26 of at least 35 mm from the pivot axis of the refrigeration device door 12, a spring element 26 being able to generate a maximum compressive force of 50 N is sufficient.

Figure 12:
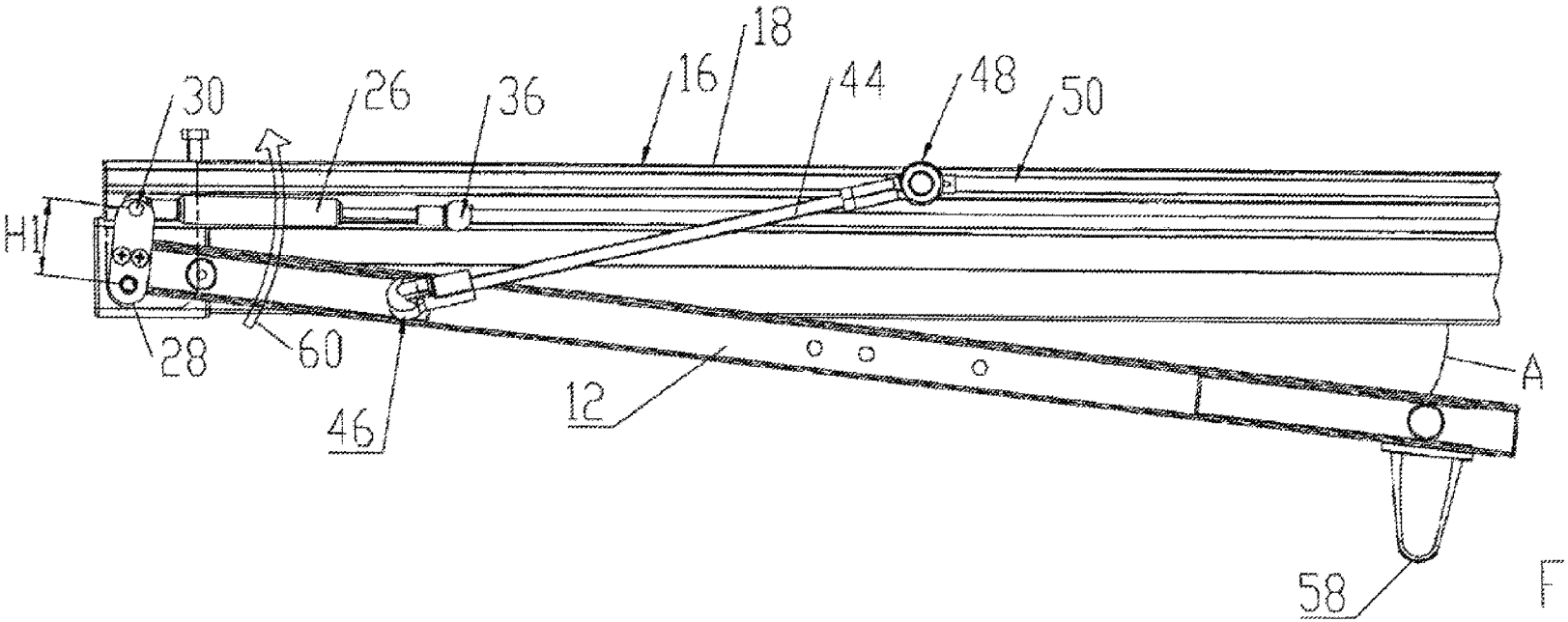
FIGS. 12 and 13 show top views of respective particular parts of the door system in respective door positions by a partially cutout illustration of the door system according to FIG. 1.

Conclusively, FIG. 12 and FIG. 13 are to illustrate again the interaction between the eccentric element 28 and the spring element 26, and how said interaction has an impact on the respective critical angles. FIG. 12 shows a lever arm H1 which has the compressive force generated by the spring element 26 with respect to the pivot axis of the refrigeration device door 12. This results in a closing torque, which is illustrated by the arrow 60 in FIG. 12. In this context, the lever arm is dependent on the opening angle A of the refrigeration device door since it results from a distance perpendicular to the effective direction of the force generated by the spring element 26 to the pivot axis of the refrigeration device door 12. Accordingly, at an opening angle A according to FIG. 13, the lever arm H2 has a different length and faces away from instead of towards the frame 16. Accordingly, the position of the door according to FIG. 13 results in a torque with a different amount and a different direction of rotation than the position of the door according to FIG. 12. Here, it is an opening torque, which is illustrated by arrow 62.

Figure 13:
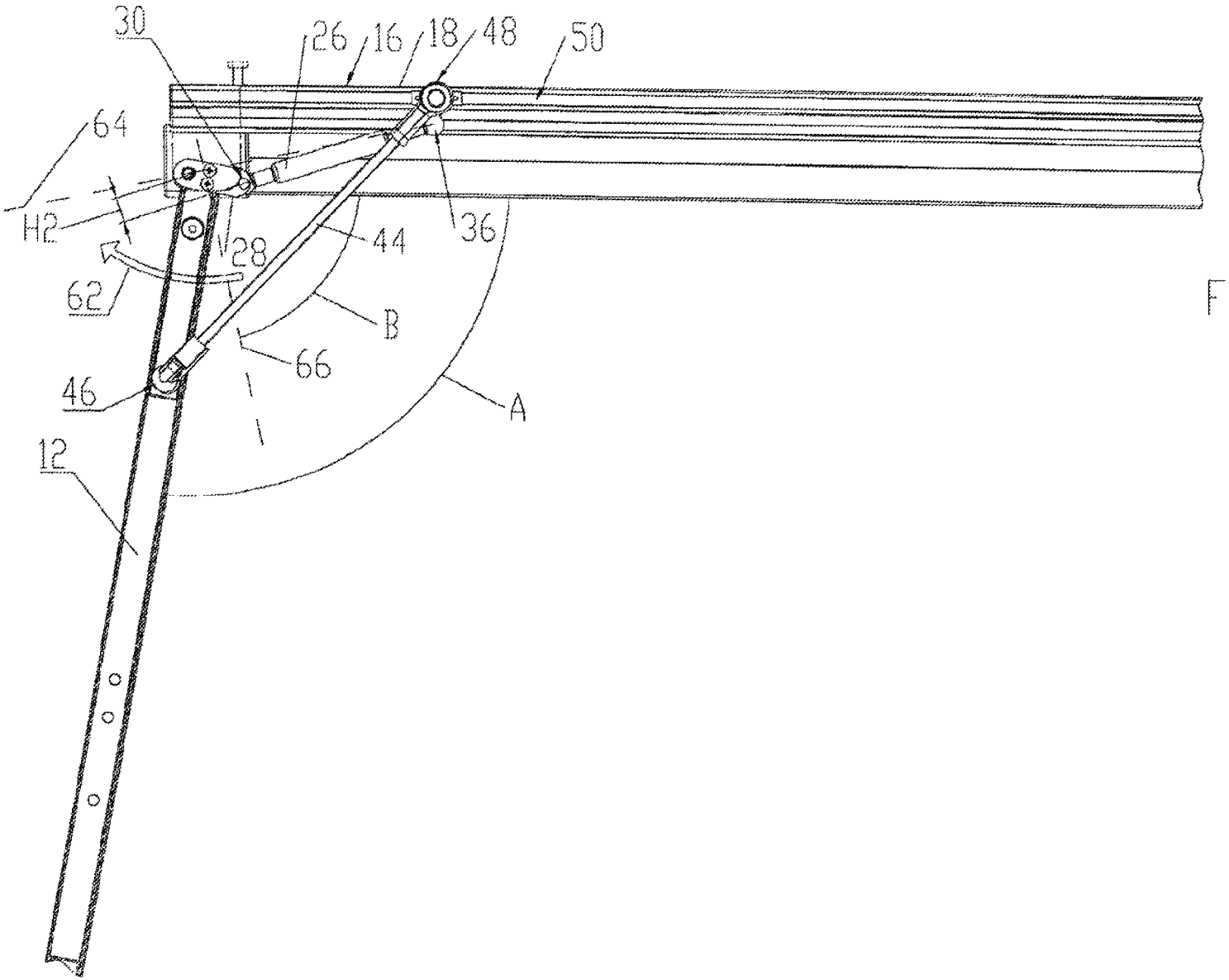

FIG. 13 demonstrates another position of the spring element 26 by a dashed line 64. In this position, the main extension direction of the spring element 26 exactly points to the pivot axis of the refrigeration device door 12, i.e., its first end 30 and its second end 36 form a straight line which lies on the pivot axis. Thus, the compressive force generated by the spring element 26 has a lever arm of zero with respect to the pivot axis of the refrigeration device door 12. Accordingly, there is no opening or closing torque. In this context, this position corresponds to the critical angle beyond which the refrigeration device door 12 closes autonomously and above which it opens autonomously. Deviations and thus two critical angles may particularly form by means of friction and a lever arm at which there is no sufficiently high torque in order to overcome respective frictional forces. In this context, a second dashed line 66 illustrates in FIG. 13 the position of the door at said critical angle, said dashed line 66 being perpendicular to the dashed line 64 and corresponding to an opening angle that is marked with B in FIG. 13. In this way, it is clearly evident how the critical angle may be altered by means of the position of the eccentric element 28 and the spring element 26 relative to the pivot axis and by means of its respective form.

Due to the lever arm's dependency on the critical angle of the refrigeration device door 12, by means of only one spring element 26 the interaction of the eccentric element 28 and the spring element 26 allows for generating torques which close or open the refrigeration device door 12 depending on the opening angle. This involves a mechanically simple and robust design which does particularly not require any additional movable and/or active, e.g., electrically controlled, elements.

Thus, the door system 10 provides for a refrigeration device which, during normal use by an end customer, definitely guarantees a high energy efficiency by a reliable closing of the interior of the refrigeration device, while at the same time a particularly convenient and quick loading and unloading of higher amounts of goods is enabled by means of the integrated function of keeping open the refrigeration device door 12.

FIGS. 14 to 20 illustrate a door system according to a further preferred embodiment of the present invention. All the features described above with respect to other embodiments may also be combined with the present embodiment according to the invention. In particular, the features described below with respect to the offset of the pivot axis are also preferred embodiments for the other embodiments.

Figure 14:
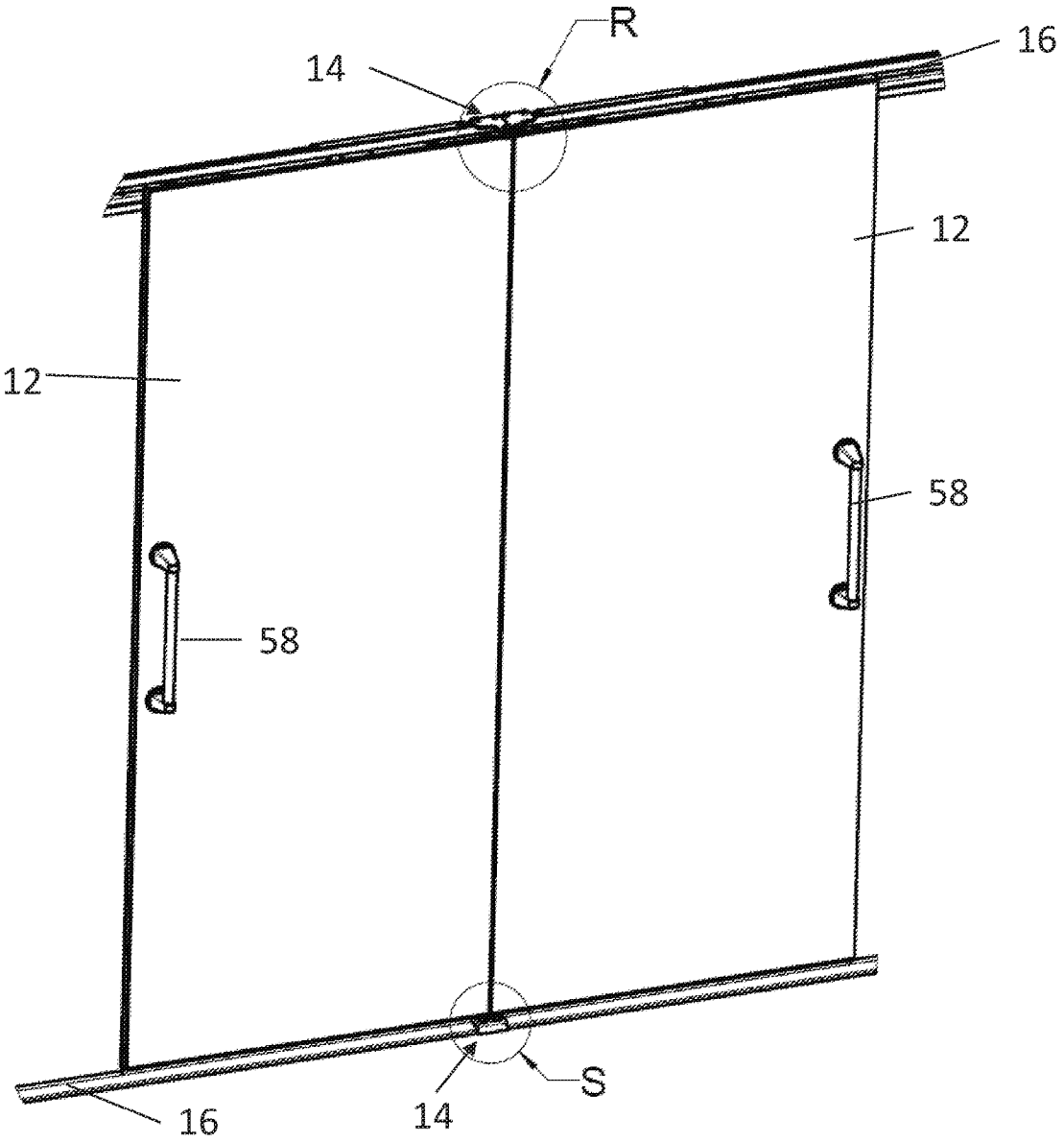
FIG. 14 shows a perspective view of a door system for a refrigeration device according to a further preferred embodiment of the present invention.
Figure 17:
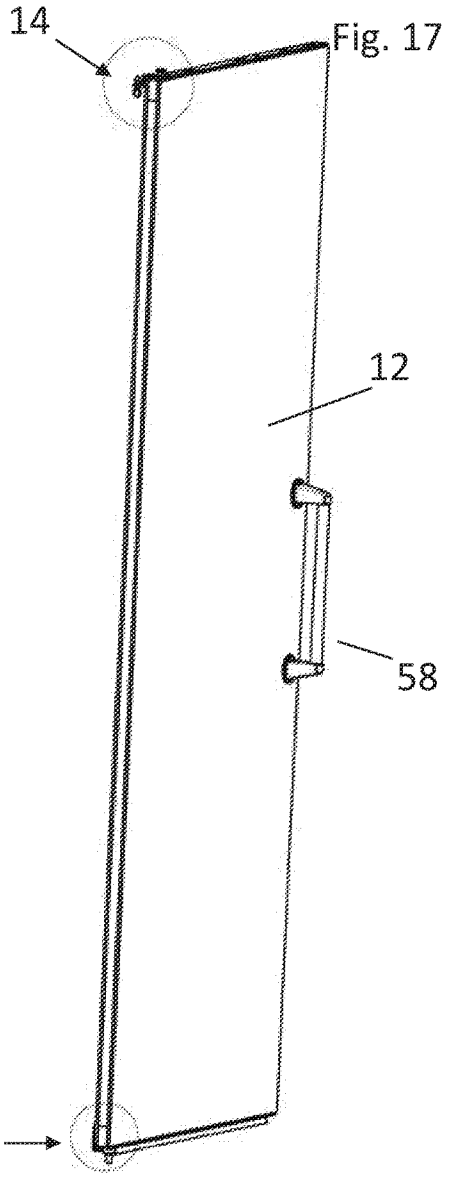
FIG. 17 shows a lateral perspective view of a door of the door system according to FIG. 14.

FIG. 14 shows a perspective view of a door system for a refrigeration device according said further preferred embodiment of the present invention. FIG. 14 illustrates only two refrigeration device doors 12. However, it is clear to the person skilled in the art that further refrigeration device doors 12 may follow. Both at their upper sides (indicated by the circle marked with R) and their lower sides (indicated by the circle marked with S), the refrigeration device doors 12 are mounted to a refrigeration device by means of a bearing assembly 14, with only a part of the frame 16 of the refrigeration device being illustrated. FIG. 17 shows a lateral perspective view of a door 12 of the door system according to FIG. 14 with the corresponding bearing assemblies 14.

Figure 15:
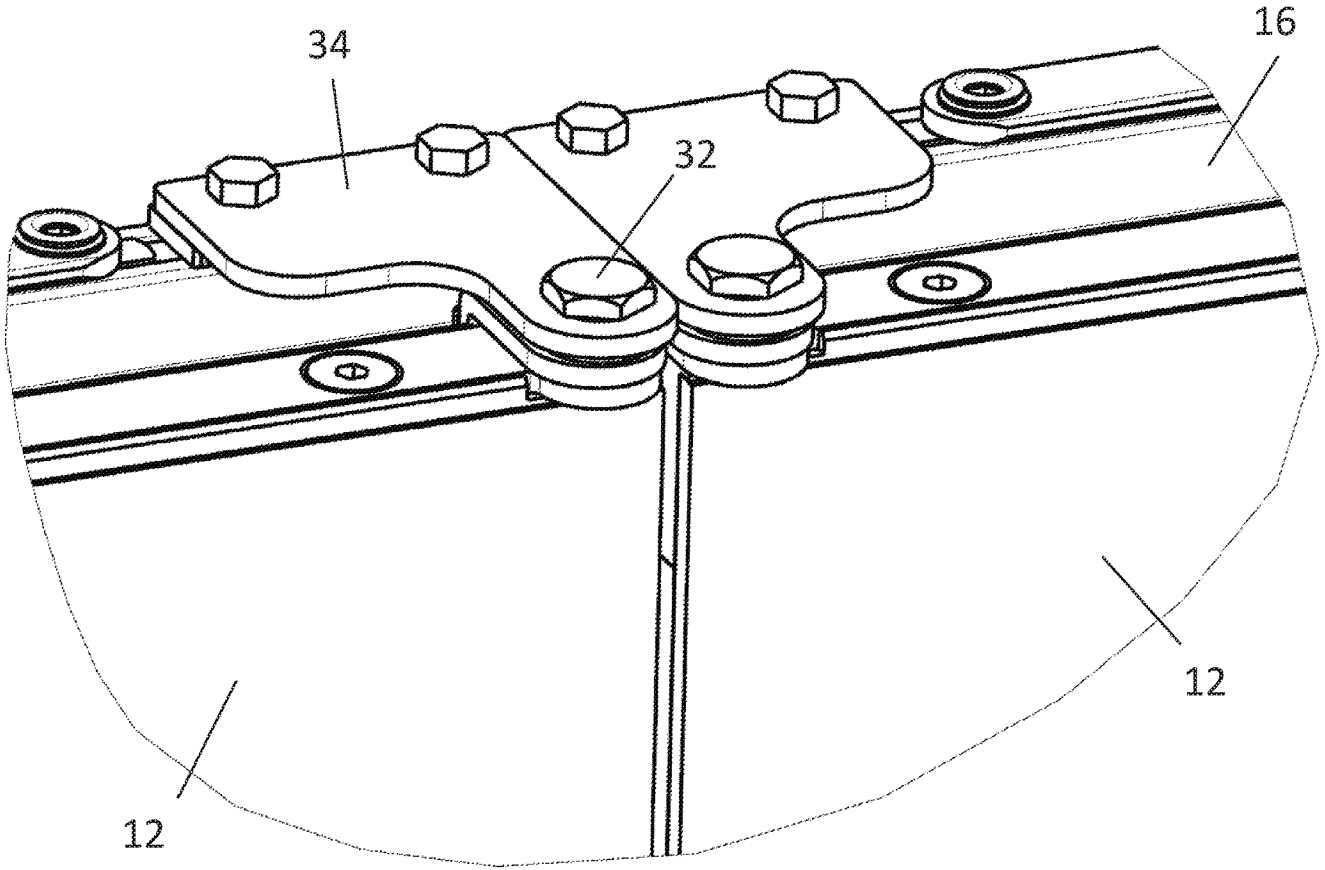
FIG. 15 shows a perspective view of the portion of the door system according to FIG. 14 marked with R.
Figure 18:
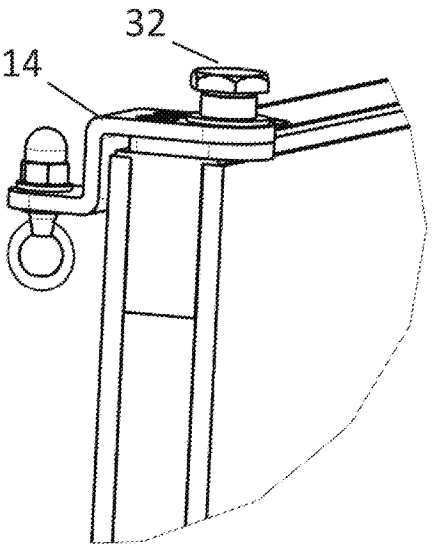
FIG. 18 shows a lateral perspective view of the portion of the door system according to FIG. 17 marked with T.
Figure 19:
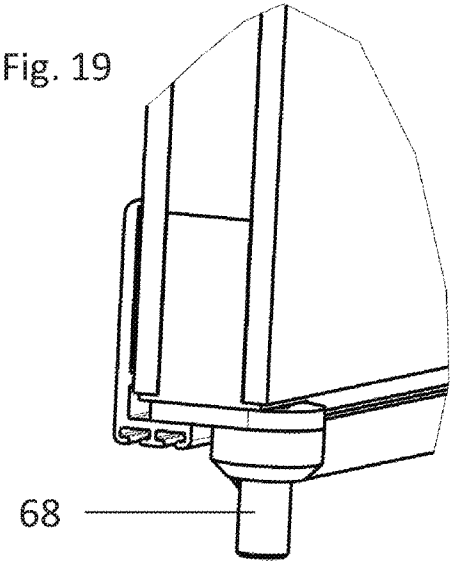
FIG. 19 shows a lateral perspective view of the portion of the door system according to FIG. 17 marked with U.
Figure 16:
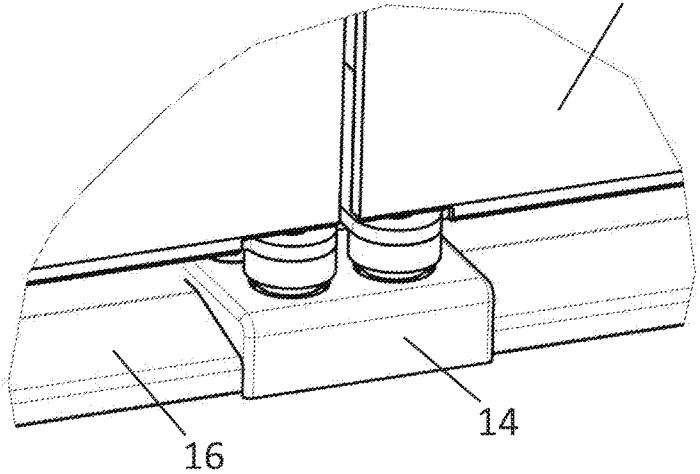
FIG. 16 shows a perspective view of the portion of the door system according to FIG. 14 marked with S.

FIG. 15 shows a perspective view of the portion of the door system according to FIG. 14 marked with R. FIG. 16 shows a perspective view of the portion of the door system according to FIG. 14 marked with S. FIG. 18 shows a lateral perspective view of the portion of the door according to FIG. 17 marked with T. FIG. 19 shows a lateral perspective view of the portion of the door according to FIG. 17 marked with U.

As can be taken from FIGS. 15 and 18, the upper bearing assemblies 14 are connected with the frame 16 of the refrigeration device by means of a screw connection 32 and a retaining member 34. At the lower end of the refrigeration device door 12, the door is pivotally mounted in a corresponding recess within the frame 16 by means of a joint pin 68.

Figure 20:
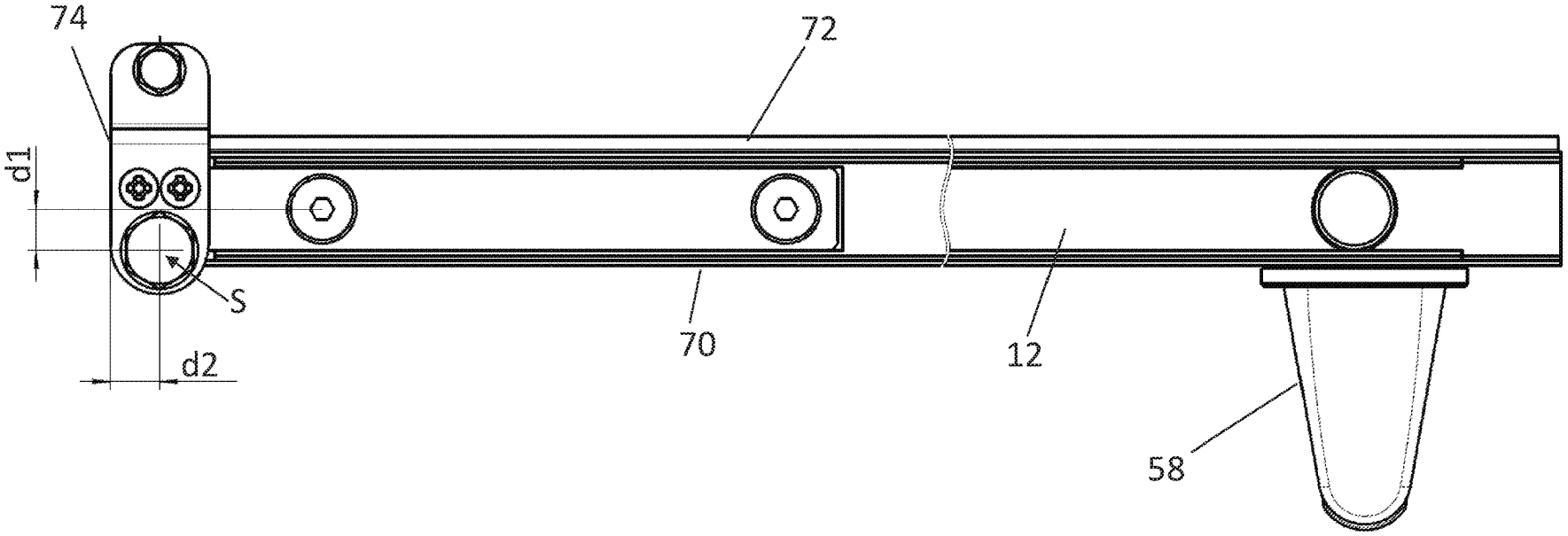
FIG. 20 shows a top view of the door according to FIG. 17.

FIG. 20 shows a top view of the door according to FIG. 17. The refrigeration device door 12 preferably comprises a center plane defined by the two outer surfaces 70 and 72. The center plane is the plane (or curved surface) whose distance to the two outer surfaces 70, 72 is the same at any point (measured perpendicular to the tangent at the plane or the curved surface at the respective point). Furthermore, the bearing assembly 14 defines a pivot axis S that is preferably offset with respect to the center plane, i.e., the center surface. Preferably, the distance d1 between the pivot axis and the center plane, i.e., the center surface, is at least 3 mm, more preferably at least 5 mm, even more preferably at least 6 mm, even more preferably at least 7 mm, and particularly preferably at least 8 mm. In the illustrated embodiment, the distance d1 is 8 mm.

With this offset, the refrigeration device door according to the invention—when in the mounted state, i.e., when being pivotally mounted to a refrigeration device—allows for an outwardly displaced pivot and/or rotary axis. As already explained above, this, in turn, preferably allows for mounting the refrigeration device door as close to the front side of the refrigeration device as possible without restricting its movability. In other words, according to the invention, the gap existing between the refrigeration device door on the one hand and the front side of the refrigeration device on the other hand may be configured to be very narrow, which, inter alia, makes it possible to do without additional sealing measures. This is particularly advantageous when the refrigeration device door is substantially configured to be completely transparent, i.e., when there are transparent spacers between, e.g., the two transparent panes of the refrigeration device door, so that also the lateral edge sections of the refrigeration device door are transparent.

It is further preferred that the refrigeration device door 12 comprises a lateral plane 74 defined by the lateral front wall, and that the distance d2 between the pivot axis S and the lateral plane is at least 3 mm, more preferably at least 5 mm, even more preferably at least 6 mm, even more preferably at least 7 mm, and particularly preferably at least 8 mm. In the illustrated embodiment, the distance d2 is 9.5 mm. Also this offset to the inside may contribute to keeping the gap between the refrigeration device and the refrigeration device door as narrow as possible and, at the same time, doing without additional measures such as, e.g., rounding off the lateral front wall.

LIST OF REFERENCE SIGNS

10 door system
12 refrigeration device door
14 bearing assembly
16 frame
18 upper ledge
20 lower ledge
22 vertical direction
24 horizontal direction
26 spring element
28 eccentric element
30 first end of the spring element
32 screw connection
34 retaining member
36 second end of the spring element
38 arrow
40 arrow
42 arrow
44 restriction member
46 first end of the restriction member
48 second end of the restriction member
50 guiding rail
52 sliding head
54 arrow
56 pin member
58 door handle
60 arrow
62 arrow
64 dashed line
66 dashed line
68 joint pin
70 outer surface
72 outer surface
74 lateral wall
A opening angle
H1 lever arm
H2 lever arm
S pivot axis
d1 distance pivot axis—center plane
d2 distance pivot axis—lateral plane

The invention claimed is:

1. A door system for a refrigeration device, wherein the door system comprises at least one refrigeration device door and a corresponding bearing assembly suitable for pivotally mounting the refrigeration device door on a refrigeration device such that the refrigeration device door may be pivoted around a substantially vertically aligned pivot axis between a closed position, in which the refrigeration device is being closed by the refrigeration device door, and an open position, which allows access to the interior of the refrigeration device, wherein the refrigeration device door defines an opening angle with respect to the refrigeration device; wherein the door system further comprises at least one gas pressure spring which is connected with the refrigeration device door and suitable for engaging with the refrigeration device such that, at an opening angle smaller than a first critical angle, the at least one gas pressure spring pushes the refrigeration device door into the closed position and, at an opening angle greater than a second critical angle, the at least one gas pressure spring pushes the refrigeration device door into the open position; and at least one restriction member by means of which the opening angle of the refrigeration device door is restricted to a maximum opening angle, wherein the restriction member is configured as a coupling rod with a first end and an opposite second end, wherein the first end of the coupling rod is connected with the refrigeration device door, and the second end of the coupling rod is suitable for engaging with the refrigeration device, wherein the maximum opening angle is adjustable.

2. The door system according to claim 1, further comprising an eccentric element by means of which the at least one gas pressure spring is connected with the refrigeration device door.

3. The door system according to claim 2, wherein the alignment of the eccentric element is adjustable with respect to the refrigeration device door in order to determine the first critical angle and/or the second critical angle.

4. The door system according to claim 1, wherein the first end of the coupling rod is pivotally connected with the refrigeration device door, and the second end of the coupling rod is suitable for being received in a guiding rail in a sliding and pivotable manner, or wherein the refrigeration device door comprises a guiding rail, wherein the first end of the coupling rod is received in the guiding rail of the refrigeration device door in a sliding and pivotable manner, and the second end of the coupling rod is suitable for being pivotally mounted on the refrigeration device.

5. The door system according to claim 1, further comprising a damping member by means of which a pivoting movement of the refrigeration device door from the open position into the closed position and/or a pivoting movement of the refrigeration device door from the closed position into the open position is being damped.

6. The door system according to claim 1, wherein the refrigeration device door comprises a center plane defined by two outer surfaces, and wherein the bearing assembly defines a pivot axis which is offset from the center plane.

7. The door system according to claim 6, wherein the distance between the pivot axis and the center plane is at least 3 mm.

8. The door system according to claim 1, wherein the refrigeration device door comprises a lateral plane defined by a lateral front wall, and wherein the bearing assembly defines a pivot axis which is offset inwardly towards the refrigeration device door with respect to the lateral plane.

9. The door system according to claim 8, wherein the distance between the pivot axis and the lateral plane is at least 3 mm.

10. A refrigeration device comprising the door system according to claim 1.

11. The refrigeration device according to claim 10, wherein the refrigeration device or the refrigeration device door comprise a guiding rail at an upper and/or a lower edge, and wherein the second end of the coupling rod is slidably and pivotally mounted in the guiding rail.

12. The refrigeration device according to claim 11, wherein the guiding rail comprises a stopper by means of which the opening angle of the refrigeration device door is restricted to a maximum opening angle.

13. The refrigeration device according to claim 10, further comprising an eccentric element by means of which the at least one gas pressure spring is connected with the refrigeration device door, wherein a first end of the at least one gas pressure spring is pivotally connected with the eccentric element, and an opposite second end of the at least one gas pressure spring is pivotally connected with the refrigeration device.

14. The refrigeration device according to claim 10, wherein the distance between the refrigeration device and the refrigeration device door is at most 6 mm.

* * * * *